US011380254B2

(12) United States Patent
Kim et al.

(10) Patent No.: US 11,380,254 B2
(45) Date of Patent: Jul. 5, 2022

(54) DISPLAY DEVICE FOR REDUCING CHARACTERISTIC DEGRADATION OF A PIXEL, AND DRIVING METHOD THEREOF

(71) Applicant: Samsung Display Co., Ltd., Yongin-si (KR)

(72) Inventors: Jong Soo Kim, Yongin-si (KR); Woo Chul Kim, Yongin-si (KR); Hyun Su Kim, Yongin-si (KR); Young Min Bae, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/407,935

(22) Filed: May 9, 2019

(65) Prior Publication Data

US 2020/0118487 A1 Apr. 16, 2020

(30) Foreign Application Priority Data

Oct. 12, 2018 (KR) ..... 10-2018-0122081

(51) Int. Cl.

| | |
|---|---|
| ***G09G 5/02*** | (2006.01) |
| ***G09G 3/3225*** | (2016.01) |
| ***G09G 3/3275*** | (2016.01) |
| *G09G 3/3291* | (2016.01) |
| *G09G 3/3208* | (2016.01) |

(52) U.S. Cl.

CPC ..... *G09G 3/3225* (2013.01); *G09G 3/3275* (2013.01); *G09G 3/3208* (2013.01); *G09G 3/3291* (2013.01); *G09G 2300/0819* (2013.01); *G09G 2300/0861* (2013.01); *G09G 2310/0248* (2013.01); *G09G 2310/0262* (2013.01); *G09G 2310/06* (2013.01); *G09G 2310/067* (2013.01); *G09G 2310/08* (2013.01); *G09G 2320/0626* (2013.01)

(58) Field of Classification Search

CPC .. G09G 3/3225; G09G 3/3275; G09G 3/3208; G09G 3/3291; G09G 2300/0819; G09G 2300/0861; G09G 2310/0248; G09G 2310/08; G09G 2310/06; G09G 2310/067; G09G 2310/0262; G09G 2320/0626

USPC ..... 345/694

See application file for complete search history.

(56) References Cited

U.S. PATENT DOCUMENTS

| | | | |
|---|---|---|---|
| 9,330,618 | B2 | 5/2016 | Yun et al. |
| 9,934,750 | B2 | 4/2018 | Park et al. |
| 9,972,265 | B2 | 5/2018 | Na et al. |

(Continued)

FOREIGN PATENT DOCUMENTS

| | | |
|---|---|---|
| KR | 10-2007-0099145 A | 10/2007 |
| KR | 10-2014-0123395 A | 10/2014 |

(Continued)

*Primary Examiner* — Adam J Snyder

(74) *Attorney, Agent, or Firm* — Lewis Roca Rothgerber Christie LLP

(57) ABSTRACT

In a display device including pixels that are coupled to data lines, that are supplied with a data signal during a display period, and that are configured to emit light corresponding to the data signal during a bias period, the display device includes a source capacitor coupled to each of the data lines, and a data driver configured to supply the data signal during the display period, to supply a bias signal during a first period in the bias period, and to not supply the bias signal during a second period.

20 Claims, 7 Drawing Sheets

(56) References Cited

U.S. PATENT DOCUMENTS

| | | | | |
|---|---|---|---|---|
| 2005/0116902 | A1* | 6/2005 | Miyzawa | G09G 3/325 345/76 |
| 2005/0219166 | A1* | 10/2005 | Kim | G09G 3/3291 345/76 |
| 2006/0071884 | A1* | 4/2006 | Kim | G09G 3/3291 345/76 |
| 2011/0122119 | A1* | 5/2011 | Bae | G09G 3/3233 345/211 |
| 2011/0164015 | A1* | 7/2011 | Kim | G09G 3/3275 345/211 |
| 2013/0099692 | A1* | 4/2013 | Chaji | G09G 3/3283 315/224 |
| 2013/0100173 | A1* | 4/2013 | Chaji | G09G 5/10 345/690 |
| 2013/0162617 | A1* | 6/2013 | Yoon | G09G 3/3233 345/211 |
| 2017/0076671 | A1* | 3/2017 | Kim | G09G 3/3266 |
| 2018/0047335 | A1 | 2/2018 | Hwang et al. | |

FOREIGN PATENT DOCUMENTS

| | | | |
|---|---|---|---|
| KR | 10-2015-0100978 | A | 9/2015 |
| KR | 10-2016-0045215 | A | 4/2016 |
| KR | 10-2018-0018888 | A | 2/2018 |

* cited by examiner

DISPLAY DEVICE FOR REDUCING CHARACTERISTIC DEGRADATION OF A PIXEL, AND DRIVING METHOD THEREOF

CROSS-REFERENCE TO RELATED APPLICATION

This application claims priority to, and the benefit of, Korean patent application 10-2018-0122081 filed on Oct. 12, 2018 in the Korean Intellectual Property Office, the entire disclosure of which is incorporated herein by reference.

BACKGROUND

1. Technical Field

The present disclosure generally relates to a display device and a driving method thereof.

2. Related Art

A display device includes a plurality of pixels arranged in a matrix form at intersection portions of a plurality of data lines, a plurality of scan lines, and a plurality of power lines. Each of the pixels generally includes an organic light emitting diode, and a driving transistor for controlling an amount of current flowing through the organic light emitting diode. The pixel generates light while supplying current from the driving transistor to the organic light emitting diode, the light having a luminance corresponding to a data signal.

In a general pixel, when a white grayscale is expressed after a black grayscale is implemented, light with a luminance that is lower than a desired luminance is generated during about two frame periods. Therefore, an image with a desired luminance corresponding to a grayscale is not displayed in each of the pixels. As a result, the uniformity of luminance is degraded, which acts as a main factor that deteriorates the image quality of a moving image.

Degradation of response characteristics of the display device results from characteristics of the driving transistor included in the pixel. In other words, a threshold voltage of the driving transistor is shifted corresponding to a voltage applied to the driving transistor during a previous frame period, and light with a luminance required in a current frame might not be generated from the organic light emitting diode due to the shifted threshold voltage.

SUMMARY

Embodiments disclosed herein provide a display device capable of reducing or preventing characteristic degradation of a pixel by applying a bias voltage to the pixel during a bias period when the display device is driven at a low frequency, and a driving method of the display device.

Embodiments disclosed herein also provide a display device for performing on/off control of the output of a bias voltage during a bias period when the display device is driven at a low frequency, and a driving method of the display device.

According to an aspect of the present disclosure, there is provided a display device including pixels that are coupled to data lines, that are supplied with a data signal during a display period, and that are configured to emit light corresponding to the data signal during a bias period, the display device including a source capacitor coupled to each of the data lines, and a data driver configured to supply the data signal during the display period, to supply a bias signal during a first period in the bias period, and to not supply the bias signal during a second period.

The data driver may be configured to supply the pixels with the bias signal during the first period, and wherein the source capacitor is configured to supply the pixels with the bias signal during the second period.

The first period and the second period may correspond to one frame period.

The first period and the second period may correspond to one horizontal period.

The data driver may include a data driving module configured to supply the data signal and the bias signal to the data lines, and a switching module configured to control electrical coupling between the data driving module and the data lines.

The switching module may be in an on-state during the display period and the first period, and may be in an off-state during the second period.

The data driver may include a data driving module configured to supply the data signal to the data lines, an analog voltage input module configured to supply the bias signal to the data lines, and a switching module configured to control electrical coupling between the data driving module and the data lines, and between the analog voltage input module and the data lines.

The switching module may be controlled to be in a first position in which the data driving module is coupled to the data lines during the display period, may be controlled to be in a second position in which the analog voltage input module is coupled to the data lines during the first period, and may be controlled to be in a third position in which the data driving module and the analog voltage input module are separated from the data lines during the second period.

The source capacitor may be configured to charge the bias signal supplied from the data driver during the first period, and may be configured to be discharged during the second period to supply the bias signal to a corresponding one of the data lines.

The source capacitor may be a parasitic capacitor of a corresponding one of the data lines.

According to an aspect of the present disclosure, there is provided a method for driving a display device including pixels that are coupled to data lines, that are supplied with a data signal during a display period, and that are configured to emit light corresponding to the data signal during a bias period, a source capacitor coupled to each of the data lines, and a data driver that is configured to supply a bias signal during a first period in the bias period, and that is configured to not supply the bias signal during a second period, the method including supplying, by the data driver, the data signal to the data lines during the display period, supplying the bias signal to the data lines during the first period in the bias period, and stopping the supply of the bias signal to the data lines during the second period.

The pixels may be supplied with the bias signal from the data driver during the first period, and may be supplied with the bias signal from the source capacitor during the second period.

The first period and the second period may correspond to one frame period.

The first period and the second period may correspond to one horizontal period.

The data driver may include a data driving module configured to supply the data signal and the bias signal to the data lines, and a switching module configured to control electrical coupling between the data driving module and the data lines.

The supplying of the bias signal may include controlling the switching module to be in an on-state, and the stopping of the supply of the bias signal may include controlling the switching module to be in an off-state.

The data driver may include a data driving module configured to supply the data signal to the data lines, an analog voltage input module configured to supply the bias signal to the data lines, and a switching module configured to control electrical coupling between the data driving module and the data lines, and between the analog voltage input module and the data lines.

The supplying of the data signal may include controlling the switching module to be in a first position in which the data driving module is coupled to the data lines during the display period, the supplying of the bias signal may include controlling the switching module to be in a second position in which the analog voltage input module is coupled to the data lines during the first period, and the stopping of the supply of the bias signal may include controlling the switching module to be in a third position in which the data driving module and the analog voltage input module are separated from the data lines during the second period.

The method may further include charging the source capacitor with the bias signal supplied from the data driver during the first period, and discharging the source capacitor during the second period to supply the bias signal to a corresponding one of the data lines.

The source capacitor may be a parasitic capacitor of a corresponding one of the data lines.

BRIEF DESCRIPTION OF THE DRAWINGS

Embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
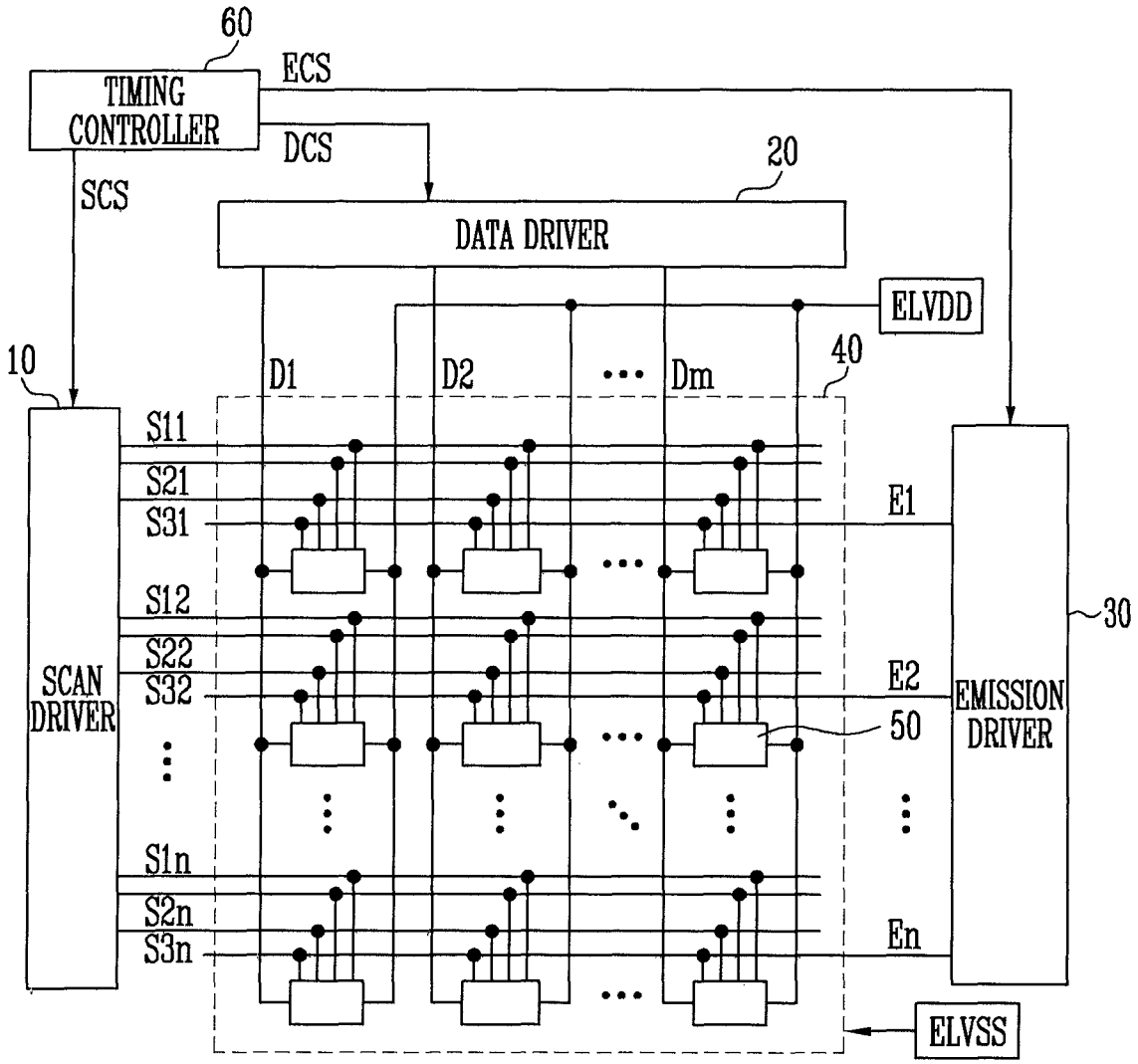
FIG. 1 is a block diagram illustrating a display device according to an embodiment of the present disclosure.

Features of the inventive concept and methods of accomplishing the same may be understood more readily by reference to the detailed description of embodiments and the accompanying drawings. Hereinafter, embodiments will be described in more detail with reference to the accompanying drawings. The described embodiments, however, may be embodied in various different forms, and should not be construed as being limited to only the illustrated embodiments herein. Rather, these embodiments are provided as examples so that this disclosure will be thorough and complete, and will fully convey the aspects and features of the present inventive concept to those skilled in the art. Accordingly, processes, elements, and techniques that are not necessary to those having ordinary skill in the art for a complete understanding of the aspects and features of the present inventive concept may not be described. Unless otherwise noted, like reference numerals denote like elements throughout the attached drawings and the written description, and thus, descriptions thereof will not be repeated. Further, parts not related to the description of the embodiments might not be shown to make the description clear. In the drawings, the relative sizes of elements, layers, and regions may be exaggerated for clarity.

Various embodiments are described herein with reference to sectional illustrations that are schematic illustrations of embodiments and/or intermediate structures. As such, variations from the shapes of the illustrations as a result, for example, of manufacturing techniques and/or tolerances, are to be expected. Further, specific structural or functional descriptions disclosed herein are merely illustrative for the purpose of describing embodiments according to the concept of the present disclosure. Thus, embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting. Additionally, as those skilled in the art would realize, the described embodiments may be modified in various different ways, all without departing from the spirit or scope of the present disclosure.

In the detailed description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. Similarly, when a first part is described as being arranged "on" a second part, this indicates that the first part is arranged at an upper side or a lower side of the second part without the limitation to the upper side thereof on the basis of the gravity direction.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

When a certain embodiment may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present disclosure.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating a display device according to an embodiment of the present disclosure.

Referring to FIG. 1, the display device according to the present embodiment includes a scan driver 10, a data driver 20, an emission driver 30, a display unit 40, and a timing controller 60.

The timing controller 60 generates a data driving control signal DCS, a scan driving control signal SCS, and an emission driving control signal ECS, corresponding to externally supplied synchronization signals. The data driving control signal DCS generated by the timing controller 60 is supplied to the data driver 20, the scan driving control signal SCS generated by the timing controller 60 is supplied to the scan driver 10, and the emission driving control signal ECS generated by the timing controller 60 is supplied to the emission driver 30.

A gate start pulse and clock signals are included in the scan driving control signal SCS. The gate start pulse controls a first timing of a scan signal. The clock signals are used to shift the gate start pulse.

An emission start pulse and clock signals are included in the emission driving control signal ECS. The emission start pulse controls a first timing of an emission control signal. The clock signals are used to shift the emission start pulse.

A source start pulse and clock signals are included in the data driving control signal DCS. The source start pulse controls a sampling start time of data. The clock signals are used to control a sampling operation.

The scan driver 10 is supplied with the scan driving control signal SCS from the timing controller 60. The scan driver 10 supplied with the scan driving control signal SCS supplies a scan signal to first scan lines S11 to S1*n*, second scan lines S21 to S2*n*, and third scan lines S31 to S3*n*. In an example, the scan driver 10 may sequentially supply a first scan signal to the first scan lines S11 to S1*n*, sequentially supply a second scan signal to the second scan lines S21 to S2*n*, and sequentially supply a third scan signal to the third scan lines S31 to S3*n*. When the first scan signal, the second scan signal, and the third scan signal are sequentially supplied, pixels 50 are selected in units of horizontal lines.

The scan driver 10 supplies the second scan signal to a jth (j is a natural number) second scan line S2*j* to overlap with the first scan signal supplied to a jth first scan line S1*j*. The first scan signal and the second scan signal may be set as signals having polarities opposite to each other. In an example, the first scan signal may be set to a low voltage, and the second scan signal may be set to a high voltage. Also, the scan driver 10 supplies the third scan signal to a jth third scan line S3*j* earlier than the second scan signal supplied to the jth second scan line S2*j*. The third scan signal may be set to the high voltage. The jth third scan line S3*j* may be replaced with a (j-1)th second scan line S2*j*-1.

Additionally, the first scan signal, the second scan signal, and the third scan signal are set to a gate-on voltage. A transistor that is included in the pixel 50 and is supplied with the first scan signal is set to a turn-on state when the first scan signal is supplied. Similarly, a transistor that is included in the pixel 50 and is supplied with the second scan signal is set to the turn-on state when the second scan signal is supplied. In addition, a transistor that is included in the pixel 50 and is supplied with the third scan signal is set to the turn-on state when the third scan signal is supplied.

The emission driver 30 is supplied with the emission driving control signal ECS from the timing controller 60. The emission driver 30 supplied with the emission driving control signal ECS supplies an emission control signal to emission control lines E1 to En. In an example, the emission driver 30 may sequentially supply the emission control signal to the emission control lines E1 to En. The emission control signal is used to control an emission time of the pixels 50. For example, a specific pixel 50 supplied with the emission control signal may be set to an emission state during a period in which the emission control signal is supplied, and may be set to a non-emission state during the other periods.

Additionally, the emission control signal and the scan signal may be set to the gate-on voltage (e.g., a low voltage) at which transistors included in the pixels 50 can be turned on (e.g., to emit light).

The data driver 20 is supplied with the data driving control signal DCS from the timing controller 60. The data driver 20 supplied with the data driving control signal DCS supplies a data signal to data lines D1 to Dm. The data signal supplied to the data lines D1 to Dm is supplied to pixels 50 selected by the first scan signal (or the second scan signal). To this end, the data driver 20 may supply the data signal to the data lines D1 to Dm to be synchronized with the first scan signal (or the second scan signal).

In various embodiments of the present disclosure, the data driver 20 supplies a bias signal to the data lines D1 to Dm, based on the data driving control signal DCS. The bias signal supplied to the data lines D1 to Dm is supplied to the pixels 50 selected by the first scan signal. To this end, the data driver 20 may supply the bias signal to the data lines D1 to Dm to be synchronized with the first scan signal (or the second scan signal).

The display unit 40 includes pixels 50 coupled to the scan lines S11 to S1*n*, S21 to S2*n*, and S31 to S3*n*, the data lines D1 to Dm, and the emission control lines E1 to En. The display unit 40 is supplied with a first driving power source ELVDD, a second driving power source ELVSS, and an initialization power source, which may be externally supplied to the display unit 40.

The pixel 50 includes a driving transistor and an organic light emitting diode. The driving transistor controls an amount of current flowing from the first driving power source ELVDD to the second driving power source ELVSS via the organic light emitting diode. The organic light emitting diode may emit light with a luminance corresponding to the amount of current. A gate electrode of the driving transistor may be initialized by the voltage of the initialization power source before the data signal is supplied.

Meanwhile, although n scan lines S11 to S1*n*, S21 to S2*n*, and S31 to S3*n* and n emission control lines E1 to En are illustrated in FIG. 1, the present disclosure is not limited thereto. In an example, one or more dummy scan lines and one or more dummy emission control lines may be additionally formed corresponding to the circuit structure of the pixels 50.

Although the first scan lines S11 to Sn, the second scan lines S21 to S2*n*, and the third scan lines S31 to S3*n* are illustrated in FIG. 1, the present disclosure is not limited thereto. In an example, only one of the scan lines S11 to S1*n*, S21 to S2*n*, or S31 to S3*n* among the first scan lines S11 to Sn, the second scan lines S21 to S2*n*, and the third scan lines S31 to S3*n* may be included corresponding to the pixel structure of the pixels 50.

Additionally, although the emission control lines E1 to En are illustrated in FIG. 1, the present disclosure is not limited thereto. In an example, reversal emission control lines may be additionally formed corresponding to the pixel structure of the pixels 50. The reversal emission control lines may be supplied with a reversal emission control signal (e.g., a signal that is opposite to the emission control signal), which may be obtained by reversing the emission control signal.

The display device according to the present embodiment is driven at a low frequency when an image (e.g., a still image) having a low frame frequency is displayed, such that power consumption can be reduced. When the display device is driven at the low frequency, the display device performs normal driving for image display in a display period including at least one frame.

A data signal supplied to the pixels 50 during the display period may be written in the pixels 50 supplied with the first scan signal (or the second scan signal), and accordingly, the pixels 50 may emit light with a luminance corresponding to the data signal.

When the display device is driven at the low frequency, as described above, characteristics of the driving transistors may be deteriorated due to hysteresis of the pixels 50. To reduce or prevent the deterioration of the characteristics of the driving transistor, the bias signal may be applied to the pixels 50 during at least one frame (hereinafter, referred to as a bias period) not including the display period. During the bias period, an on-bias state of the driving transistor of each pixel 50 may be maintained by the bias signal.

In this embodiment, although the supply of the data signal is stopped during the bias period, each pixel 50 stores a voltage corresponding to the data signal that is supplied during the display period, and thus continuous emission can be maintained substantially identically to the display period.

In an embodiment, when the bias signal is continuously applied during the bias period, the effect in which power consumption is reduced when the display device is driven at the low frequency may be decreased. Accordingly, in the present disclosure, there is provided a method for controlling on/off of the bias signal during the bias period.

Figure 2:
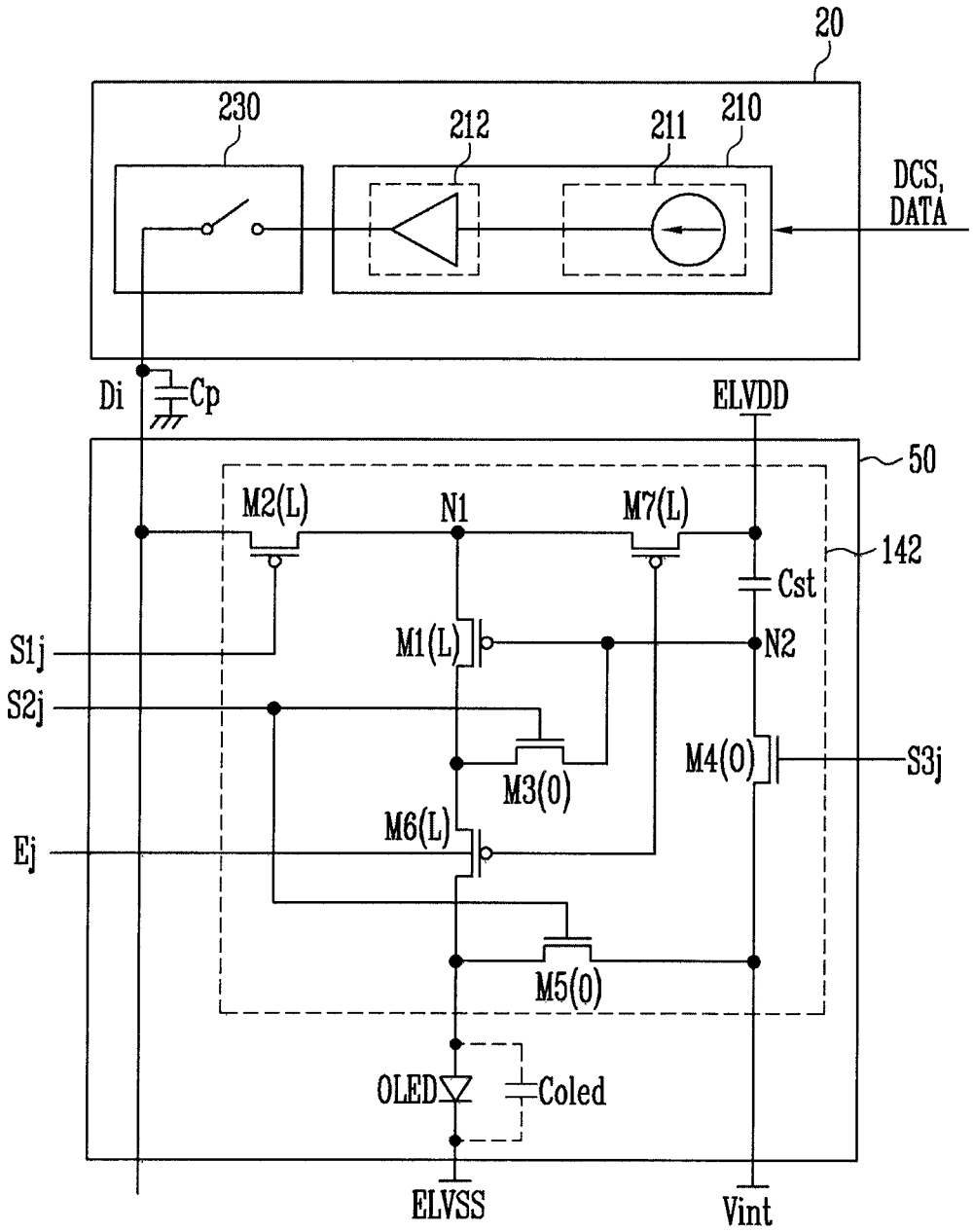
FIG. 2 is a diagram illustrating an embodiment of a pixel and a data driver, which are shown in FIG. 1.

FIG. 2 is a diagram illustrating an embodiment of the pixel and the data driver, which are shown in FIG. 1. For convenience of description, an example in which a pixel 50 is located on a jth horizontal line and is coupled to a data driver 20 through an ith data line Di is illustrated in FIG. 2.

Referring to FIG. 2, the data driver 20 according to the present embodiment includes a data driving module 210 and a switching module 230. For convenience of description, a case where the switching module 230 is coupled to the ith data line Di is illustrated in FIG. 2, but the switching module 230 may be coupled to all of the data lines D1 to Dm.

The data driving module 210 receives the data driving control signal DGS and image data DATA from the timing controller 60 during a display period. The data driving module 210 converts the image data DATA into a data signal, and outputs the converted data signal to the switching module 230.

Also, the data driving module 210 provides a bias signal having an analog voltage to the switching module 230 during a bias period including at least one frame after the display period. In an embodiment, the bias signal may have a level that is higher than that of a data signal corresponding to a white grayscale, which is applied to the data lines D1 to Dm.

In various embodiments, the data driving module 210 may include a source unit 211 and a buffer unit 212.

The source unit 211 generates a data signal having a voltage corresponding to a grayscale value of the image data DATA, and outputs the generated data signal to the buffer unit 212. The buffer unit 212 compensates for the data signal such that the voltage of the data signal has a constant level, and outputs the compensated data signal to the data line Di. The buffer unit 212 may include, for example, an amplifier in the form of a source follower.

In an embodiment of the present disclosure, another switching module may be further provided between the source unit 211 and the buffer unit 212. The switching module, along with the separate switching module 230 that will be described later, may control an output of the data driving module 210. For example, the switching module may control the data signal or the bias signal to be output or to not be output to the data line Di from the data driving module 21Q by controlling on/off of an output of the source unit 211.

The data driving module 210 may further include a shift register and a latch. The shift register shifts image data transferred from the timing controller 60 to correspond to the data line Di. The latch temporarily stores the image data shifted by the shift register, and outputs the stored image data to a corresponding source unit 211.

The switching module 230 controls an output of the data driving module 210. For example, the switching module 230 controls the data signal or the bias signal to be output or to not be output to the data line Di from the data driving module 210 by controlling on/off of an output of the amplifier of the buffer unit 212.

An operation of the switching module 230 may be controlled by the timing controller 60. For example, the timing controller 60 may allow the data signal to be output to the data line Di by controlling the switching module 230 to be in an on-state such that the data driving module 210 and the data line Di are electrically coupled to each other during the display period.

Meanwhile, the timing controller 60 may allow the bias signal to be output to the data line Di by controlling the switching module 230 such that the data driving module 210 and the data line Di are electrically coupled to each other in at least one frame of the bias period. Also, the timing controller 60 may allow the bias signal to not be output to the data line Di by controlling the switching module 230 such that the data driving module 210 and the data line Di are electrically short-circuited to each other in at least one another frame. Such a bias driving method will be described in detail below with reference to FIGS. 3 and 6.

Alternatively, in an embodiment, the timing controller 60 may allow the bias signal to not be output to the data line Di by controlling the switching module 230 such that the data driving module 210 and the data line Di are electrically coupled to each other during at least one horizontal period in one frame during the bias period. Also, the timing controller 60 may allow the bias signal to not be output to the data line Di by controlling the switching module 230 such that the data driving module 210 and the data line Di are electrically short-circuited to each other during at least one other horizontal period in the one frame. Such a bias driving method will be described in detail below with reference to FIGS. 4 and 7.

Continuing to refer to FIG. 2, the pixel 50 according to the present embodiment includes an oxide semiconductor thin film transistor and a Low Temperature Poly-Silicon (LTPS) thin film transistor.

The oxide semiconductor thin film transistor can be formed through a low temperature process, and has a charge mobility lower than that of the LTPS thin film transistor. The oxide semiconductor thin film transistor has excellent off-current characteristics. The oxide semiconductor thin film transistor includes a gate electrode, a source electrode, and a drain electrode. The oxide semiconductor thin film transistor includes an active layer formed of an oxide semiconductor. The oxide semiconductor may be set as an amorphous or crystalline oxide semiconductor. The oxide semiconductor thin film transistor may be implemented with an n-type transistor.

The LTPS thin film transistor has high electron mobility, and accordingly has fast driving characteristics. The LTPS thin film transistor includes a gate electrode, a source electrode, and a drain electrode. The LTPS thin film transistor includes an active layer formed of poly-silicon. The LTPS thin film transistor may be implemented with a p-type or n-type transistor. In the present disclosure, a case where the LTPS thin film transistor is implemented with the p-type transistor is assumed.

The pixel 50 includes a pixel circuit 142 and an organic light emitting diode OLED.

An anode electrode of the organic light emitting diode OLED is coupled to the pixel circuit 142, and a cathode electrode of the organic light emitting diode OLED is coupled to a second driving power source ELVSS. The organic light emitting diode OLED generates light with a luminance (e.g., a predetermined luminance) corresponding to an amount of current supplied from the pixel circuit 142.

The pixel circuit 142 controls an amount of current flowing from a first driving power source ELVDD to the second driving power source ELVSS via the organic light emitting diode OLED corresponding to a data signal. To this end, the pixel circuit 142 includes a first transistor (driving transistor) M1(L), a second transistor M2(L), a third transistor M3(O), a fourth transistor M4(O), a fifth transistor M5(O), a sixth transistor M6(L), a seventh transistor M7(L), and a storage capacitor Cst.

A first electrode of the first transistor M1(L) is coupled to a first node N1, and a second electrode of the first transistor M1(L) is coupled to a first electrode of the sixth transistor M6(L). In addition, a gate electrode of the first transistor M1(L) is coupled to a second node N2. The first transistor M1(L) controls an amount of current supplied from the first driving power source ELVDD to the second driving power source ELVSS via the organic light emitting diode OLED corresponding to a voltage charged in the storage capacitor Cst. To secure a fast driving speed, the first transistor M1(L) is implemented with the LTPS thin film transistor. The first transistor M1(L) is implemented with the p-type transistor.

The second transistor M2(L) is coupled between the data line Di and the first node N1. In addition, a gate electrode of the second transistor M2(L) is coupled to a jth first scan line S1*j*. The second transistor M2(L) is turned on when a first scan signal is supplied to the jth first scan line S1*j* to electrically couple the data line Di and the first node N1 to each other. The second transistor M2(L) is implemented with the LTPS thin film transistor. The second transistor M2(L) is implemented with the p-type transistor.

The third transistor M3(O) is coupled between the second electrode of the first transistor M1(L) and the second node N2. In addition, a gate electrode of the third transistor M3(O) is coupled to a jth second scan line S2*j*. The third transistor M3(O) is turned on when a second scan signal is supplied to the jth second scan line S2*j*, to couple the first transistor M1(L) in a diode form.

The third transistor M3(O) is implemented with the oxide semiconductor thin film transistor. The third transistor M3(O) is implemented with the n-type transistor. When the third transistor M3(O) is implemented with the oxide semiconductor thin film transistor, a leakage current flowing toward the second electrode of the first transistor M1(L) from the second node N2 is reduced or minimized, and accordingly, an image with a desired luminance can be displayed.

The fourth transistor M4(O) is coupled between the second node N2 and an initialization power source Vint. In addition, a gate electrode of the fourth transistor M4(O) is coupled to a jth third scan line S3*j*. The fourth transistor M4(O) is turned on when a third scan signal is supplied to the jth third scan line S3*j* to supply the voltage of the initialization power source Vint to the second node N2.

The fourth transistor M4(O) is implemented with the oxide semiconductor thin film transistor. The fourth transistor M4(O) is implemented with the n-type transistor. When the fourth transistor M4(O) is implemented with the oxide semiconductor thin film transistor, a leakage current flowing through the initialization power source Vint from the second node N2 is reduced or minimized, and accordingly, an image with a desired luminance can be displayed.

The fifth transistor M5(O) is coupled between the anode electrode of the organic light emitting diode OLED and the initialization power source Vint. In addition, a gate electrode of the fifth transistor M5(O) is coupled to the jth second scan line S2*j*. The fifth transistor M5(O) is turned on when the second scan signal is supplied to the jth second scan line S2*j* to supply the voltage of the initialization power source Vint to the anode electrode of the organic light emitting diode OLED. The fifth transistor M5(O) is implemented with the n-type transistor.

Meanwhile, when the fifth transistor M5(O) is implemented with the oxide semiconductor thin film transistor, a leakage current supplied to the initialization power source Vint from the anode electrode of the organic light emitting diode OLED during an emission period can be reduced or minimized. When the leakage current supplied to the initialization power source Vint from the anode electrode of the organic light emitting diode OLED is reduced or minimized, the organic light emitting diode OLED can generate light with a desired luminance.

Meanwhile, the voltage of the initialization power source Vint may be set to a voltage that is lower than that of the data signal. When the voltage of the initialization power source Vint is supplied to the anode electrode of the organic light emitting diode OLED, a parasitic capacitor (hereinafter, referred to as an "organic capacitor Coled") of the organic light emitting diode OLED is discharged. When the organic capacitor Coled is discharged, the black expression ability of the pixel 50 is improved.

In detail, the organic capacitor Coled charges a voltage (e.g., a predetermined voltage), corresponding to a current supplied from the pixel circuit 142 during a previous frame period. When the voltage (e.g., the predetermined voltage) is charged in the organic capacitor Coled, light may be relatively easily emitted from the organic light emitting diode OLED by a low current.

Meanwhile, a black data signal may be supplied to the pixel circuit 142 in a current frame period. When the black data signal is supplied, the pixel circuit 142 ideally supplies no current to the organic light emitting diode OLED. However, although the black data signal is supplied, a leakage (e.g., a predetermined leakage) current may be supplied to the organic light emitting diode OLED from the first transistor M1(L). When the organic capacitor Coled is in a charged state, the organic light emitting diode OLED may minutely emit light (e.g., a relatively small amount of light may be emitted), and therefore, the black expression ability of the pixel 50 is degraded.

On the other hand, when the organic capacitor Coled is discharged by the initialization power source Vint, the organic light emitting diode OLED is set to be in the non-emission state even when a leakage current is supplied from the first transistor M1(L). That is, the leakage current from the first transistor M1(L) precharges the organic capacitor Coled, and accordingly, the organic capacitor Coled maintains the non-emission state.

The sixth transistor M6(L) is coupled between the second electrode of the first transistor M1(L) and the anode electrode of the organic light emitting diode OLED. In addition, a gate electrode of the sixth transistor M6(L) is coupled to a jth emission control line Ej. The sixth transistor M6(L) is turned on when an emission control signal is supplied to the emission control line Ej, and is turned off when the emission control signal is not supplied. The sixth transistor M6(L) is implemented with the LTPS thin film transistor. The sixth transistor M6(L) is implemented with the p-type transistor.

The seventh transistor M7(L) is coupled between the first driving power source ELVDD and the first node N1. In addition, a gate electrode of the seventh transistor M7(L) is coupled to the emission control line Ej. The seventh transistor M7(L) is turned on when the emission control signal is supplied to the emission control line Ej, and is turned off when the emission control signal is not supplied. The seventh transistor M7(L) is implemented with the LTPS thin film transistor. The seventh transistor M7(L) is implemented with the p-type transistor.

The storage capacitor Cst is coupled between the first driving power source ELVDD and the second node N2. The storage capacitor Cst charges a voltage corresponding to the data signal and a threshold voltage of the first transistor M1(L).

Meanwhile, in the present embodiment described above, the third transistor M3(O) and the fourth transistor M4(O), which are coupled to the second node N2, are implemented with the oxide semiconductor thin film transistor. When the third transistor M3(O) and the fourth transistor M4(O) are implemented with the oxide semiconductor thin film transistor, the leakage current from the second node N2 is reduced or minimized, and accordingly, an image with a desired luminance can be displayed.

Also, in the present embodiment described above, the transistors M7(L), M1(L), and M6(L) located on a current supply path for supplying current to the organic light emitting diode OLED are implemented with the LTPS thin film transistor. When the transistors M7(L), M1(L), and M6(L) located on the current supply path are implemented with the LTPS thin film transistor, current can be stably supplied to the organic light emitting diode OLED due to the fast driving characteristics of the LTPS thin film transistor.

Meanwhile, in an embodiment of the present disclosure, the pixel 50 is not limited by FIG. 2, and may be implemented with various types of circuits.

Meanwhile, in various embodiments of the present disclosure, a parasitic capacitor Cp may be equally formed in the data line Di. The parasitic capacitor Cp may be replaced with a separate data capacitor additionally formed in the data line Di. The parasitic capacitor Cp serves as a source capacitor that temporarily stores a data signal or bias signal, which is supplied to the data line Di, and supplies the stored data signal or bias signal to the pixel 50.

Figure 3:
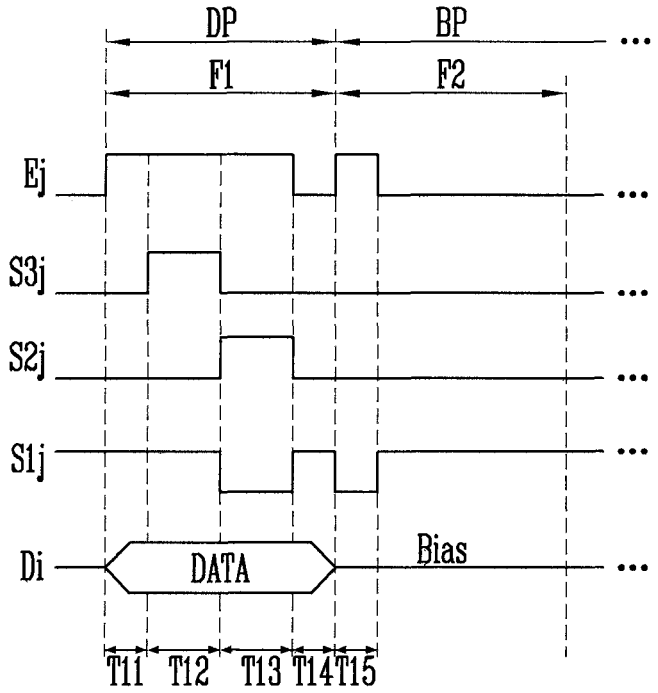
FIG. 3 is a timing diagram illustrating an example of a driving method of the pixel shown in FIG. 2.

FIG. 3 is a timing diagram illustrating an example of a driving method of the pixel shown in FIG. 2. In FIG. 3, for convenience of description, a driving method of the pixel 50 coupled to the ith data line Di, the jth first, second, and third scan lines S1*j*, S2*j*, and S3*j*, and the jth emission control line Ej is described as an example.

Referring to FIGS. 2 and 3, during a display period DP, the display device performs driving for image display.

For example, during a first period T11, the emission control signal is not supplied to the jth emission control line Ej. When the emission control signal is not supplied, the sixth transistor M6(L) and the seventh transistor M7(L) are turned off. When the sixth transistor M6(L) is turned off, the electrical coupling between the first transistor M1(L) and the organic light emitting diode OLED is interrupted. When the seventh transistor M7(L) is turned off, the electrical coupling between the first driving power source ELVDD and the first node N1 is interrupted. Therefore, the pixel 50 is set to be in the non-emission state during a period in which the emission control signal is not supplied.

During a second period T12, the third scan signal is supplied to the jth third scan line S3*j*. When the third scan signal is supplied, the fourth transistor M4(O) is turned on. When the fourth transistor M4(O) is turned on, the voltage of the initialization power source Vint is supplied to the second node N2.

During a third period T13, the first scan signal is supplied to the jth first scan line S1*j*, and the second scan signal is supplied to the jth second scan line S2*j*. In addition, a data signal is supplied to the data line Di during the second period T12.

When the first scan signal is supplied, the second transistor M2(L) is turned on. In addition, when the second scan signal is supplied, the third transistor M3(O) and the fifth transistor M5(O) are turned on.

When the fifth transistor M5(O) is turned on, the voltage of the initialization power source Vint is supplied to the anode electrode of the organic light emitting diode OLED. When the voltage of the initialization power source Vint is supplied to the anode electrode of the organic light emitting diode OLED, the organic capacitor Coled is discharged.

When the second transistor M2(L) is turned on, the data line Di and the first node N1 are electrically coupled to each other. Then, the data signal from the data line Di is supplied to the first node N1.

When the third transistor M3(O) is turned on, the first transistor M1(L) is coupled in a diode form. Because the second node N2 is initialized to the voltage of the initialization power source Vint, which is lower than the voltage of the data signal, the first transistor M1(L) is turned on.

When the first transistor M1(L) is turned on, the data signal supplied to the first node N1 is supplied to the second node N2 via the first transistor M1(L) coupled in diode form. The second node N2 is set to have a voltage corresponding to the data signal and the threshold voltage of the first transistor M1(L). The storage capacitor Cst charges the voltage applied to the second node N2.

During a fourth period T14, the emission control signal is supplied to the emission control line Ej. When the emission control signal is supplied to the emission control line Ej, the sixth transistor M6(L) and the seventh transistor M7(L) are turned on.

When the sixth transistor M6(L) is turned on, the first transistor M1(L) and the organic light emitting diode OLED are electrically coupled to each other. When the seventh transistor M7(L) is turned on, the first driving power source ELVDD and the first node N1 are electrically coupled to each other. The first transistor M1(L) controls an amount of current flowing from the first driving power source ELVDD to the second driving power source ELVSS via the organic light emitting diode OLED according to the voltage of the second node N2.

Meanwhile, the second node N2 is coupled to the third transistor M3(O) and the fourth transistor M4(O), and accordingly, a leakage current is reduced or minimized. Thus, the second node N2 can maintain a desired voltage during one frame period, and the pixel 50 can generate light with a desired luminance corresponding to the data signal during the one frame period.

Meanwhile, although a waveform by which pixels 50 on a jth pixel row are driven during the one frame period is illustrated in the above, the present disclosure is not limited thereto. For example, during the one frame period, all of the pixels 50 included in the display unit 40 pass through the first to fourth periods T11 to T14, and accordingly, a voltage corresponding to the data signal may be stored in the pixels 50.

During a bias period BP, the display device performs bias driving for reducing or preventing the deterioration of characteristics of the driving transistor included in the pixel 50.

For example, during a fifth period T15, the supply of the emission control signal to the emission control line Ej is stopped, and the first scan signal is supplied to the jth first scan line S1*j*. Also, during the fifth period T15, a bias signal is applied to the data line Di. The bias signal may be supplied from the data driver 20, or may be supplied from the precharged parasitic capacitor Cp according to a control state of the switching module 230 of the data driver 20. This will be described in detail below with reference to FIGS. 4 to 8.

When the supply of the emission control signal is stopped, the sixth transistor M6(L) and the seventh transistor M7(L) are turned off. In addition, when the first scan signal is supplied, the second transistor M2(L) is turned on.

When the second transistor M2(L) is turned on, the data line Di and the first node N1 are electrically coupled to each other. Then, the bias signal from the data line Di is supplied to the first node N1.

Meanwhile, when the sixth transistor M6(L) is turned off, the electrical coupling between the first transistor M1(L) and the organic light emitting diode OLED is interrupted. When the seventh transistor M7(L) is turned off, the electrical coupling between the first driving power source ELVDD and the first node N1 is interrupted. Therefore, the organic light emitting diode OLED does not unnecessarily emit light, corresponding to the bias signal.

In addition, the third transistor M3(O) maintains a turn-off state during a period in which the bias signal is not supplied. When the third transistor M3(O) is set to be in the turn-off state, the storage capacitor Cst maintains a voltage of the data signal, which is charged in a first frame period, regardless of the bias signal supplied to the first node N1.

Hereinafter, embodiments in which the bias signal is supplied to the data lines Q1 to Dm so as to perform a bias operation on the pixel 50 will be described in detail.

Figure 4:
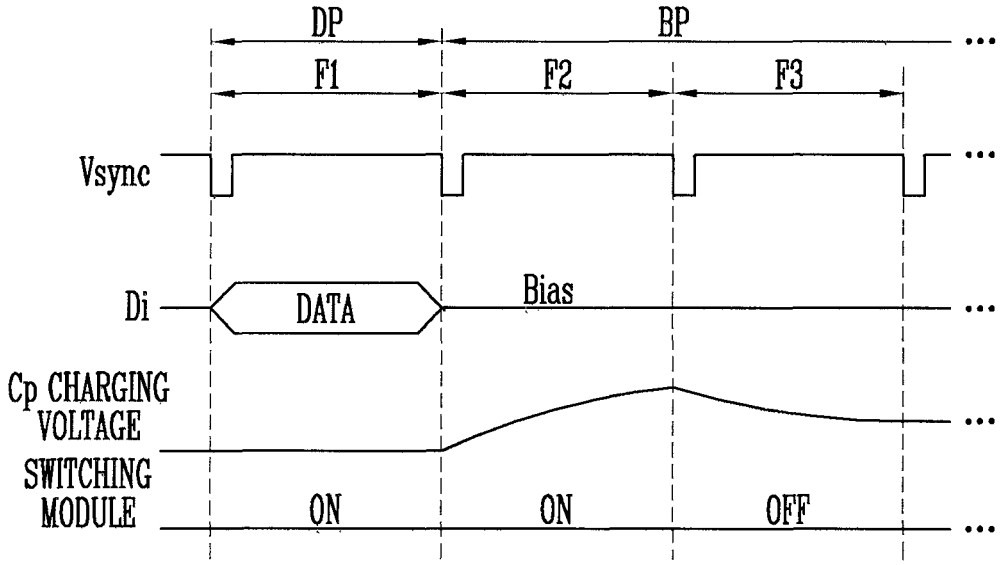
FIG. 4 is a timing diagram illustrating a driving method of the display device according to a first embodiment of the present disclosure.

FIG. 4 is a timing diagram illustrating a driving method of the display device according to a first embodiment of the present disclosure. In FIG. 4, only a signal corresponding to an ith data line Di is illustrated for convenience of description.

In FIG. 4, a pulse timing of a vertical synchronization signal Vsync is illustrated. The vertical synchronization signal Vsync is a signal for defining one frame period of the display device. That is, the period of a pulse of the vertical synchronization signal Vsync may be set to become the one frame period.

Referring to FIGS. 1 to 4, a first frame F1 corresponds to a display period DP in which a data signal is supplied to the pixel 50, and second to nth frames F2 to Fn correspond to a bias period BP in which the data signal is not supplied to the pixel 50.

During the display period DP, the display device performs driving for image display. During the display period DP, the switching module 230 of the data driver 20 is controlled to be in the on-state to supply a data signal to the data lines D1 to Dm. The display device sequentially controls supply of an emission control signal and first to third scan signals to respective pixel rows to store a voltage corresponding to the data signal in the pixels 50 of all of the pixel rows. A driving method during the display period DP is the same as described in FIG. 3, and therefore, a repeated detailed description will be omitted.

During the bias period BP, the display device performs bias driving for reducing or preventing the deterioration of the characteristics of the driving transistor included in the pixel 50. The display device supplies a bias signal to the pixels 50 through the data lines D1 to Dm. In the first embodiment of the present disclosure, the display device supplies the bias signal to the data lines D1 to Dm from the data driver 20 in at least one frame during the bias period BP, and supplies the bias signal to the data lines D1 to Dm from the parasitic capacitor Cp in at least one other frame during the bias period BP.

For example, during the second frame F2, the switching module 230 of the data driver 20 is controlled to be in the on-state. Accordingly, the bias signal is supplied to the data lines D1 to Dm from the data driver 20. When the bias signal is supplied to the data lines D1 to Dm, and when the supply of the emission control signal and the first scan signal to the respective pixel rows are sequentially controlled, a bias operation on the pixels 50 on all the pixel rows can be performed.

Meanwhile, during the second frame F2, the parasitic capacitor Cp of each of the data lines D1 to Dm is charged with a bias voltage by the bias signal supplied to the data lines D1 to Dm.

During the third frame F3, the switching module 230 of the data driver 20 is controlled to be in an off-state. Accordingly, the bias signal is not supplied to the data lines D1 to Dm from the data driver 20. When the parasitic capacitor Cp charged with the bias signal during the second frame F2 is discharged, the bias signal may be supplied to each of the data lines D1 to Dm.

When the first scan signal is sequentially supplied to the pixel rows, the second transistor M2(L) included in each of the pixels 50 is turned on. That is, when the second transistor M2(L) is turned on, a voltage of the bias signal, which is charged in the parasitic capacitor Cp during the previous frame F2, is supplied to the first node of each of the pixels 50, and accordingly, the first transistor M1(L) may be set to be in the on-bias state.

As described above, the display device according to the present disclosure can supply the bias signal to the pixel 50 from the data driver 20 or the parasitic capacitor Cp while controlling on/off of the switching module 230 of the data driver 20 in units of frames during the bias period BP. Accordingly, the display device according to the present disclosure can reduce power consumption caused by the data driver 20 during the bias period BP, and can effectively perform the bias operation on the pixels 50.

Figure 5:
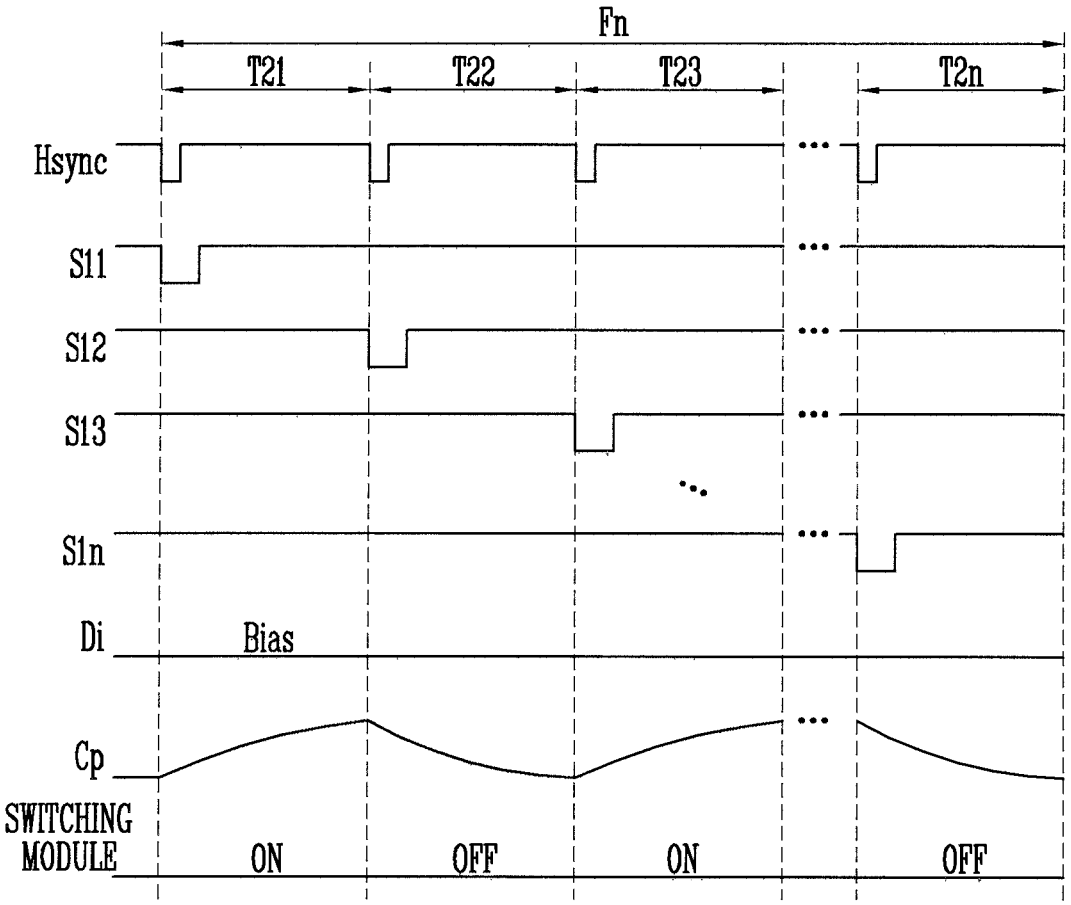
FIG. 5 is a timing diagram illustrating a driving method of the display device according to a second embodiment of the present disclosure.

FIG. 5 is a timing diagram illustrating a driving method of the display device according to a second embodiment of the present disclosure. For convenience of description, only signals corresponding to an ith data line Di, a first first scan line S11, a second first scan line S12, a third first scan line S13, and an nth first scan line S1*n* are illustrated in FIG. 5.

In FIG. 5, a pulse timing of a horizontal synchronization signal Hsync is illustrated. The horizontal synchronization signal Hsync is a signal for defining one horizontal period 1H. That is, the period of a pulse of the horizontal synchronization signal Hsync may be set to become the one horizontal period. In addition, an n frame Fn that is an arbitrary frame during a bias period BP is illustrated in FIG. 5. The display device performs driving for image display during a display period DP, and an operation in the display period DP is the same as described with reference to FIG. 3.

Referring to FIGS. 1 to 3 and 5, during the bias period BP, the display device performs bias driving for reducing or preventing the deterioration of the characteristics of the driving transistor included in the pixel 50. The display device supplies a bias signal to the pixels 50 through the data lines D1 to Dm. In the second embodiment of the present disclosure, the display device supplies the bias signal to the data lines D1 to Dm from the data driver 20 in at least one horizontal period within one frame during the bias period BP, and supplies the bias signal to the data lines D1 to Dm from the parasitic capacitor Cp in at least one other horizontal period within the one frame during the bias period BP.

For example, a first scan signal is supplied to the first first scan line S11 during a first horizontal period T21 within the nth frame Fn. In addition, the switching module 230 of the data driver 20 is controlled to be in the on-state during the first horizontal period T21. Accordingly, the bias signal is supplied to the data lines D1 to Dm from the data driver 20.

When the bias signal is supplied to the data lines D1 to Dm, and when the first scan signal is supplied to the first first scan line S11, the bias signal may be supplied to pixels 50 included in a first pixel row such that a bias operation on the corresponding pixels 50 is performed.

Meanwhile, the parasitic capacitor Cp of each of the data lines D1 to Dm is charged with a bias voltage by the bias signal supplied to the data lines D1 to Dm during the first horizontal period T21.

The first scan signal is supplied to the second first scan line S12 during a second horizontal period T22. In addition, the switching module 230 of the data driver 20 is controlled to be in the off-state during the second horizontal period T22. Accordingly, the bias signal is not supplied to the data lines D1 to Dm from the data driver 20. When the parasitic capacitor Cp charged with the bias signal during the first horizontal period T21 is discharged, the bias signal may be supplied to each of the data lines D1 to Dm.

When the bias signal is supplied to the data lines D1 to Dm, and when the first scan signal is supplied to the second first scan signal S12, the bias signal may be supplied to pixels 50 included in a second pixel row such that a bias operation on the corresponding pixels 50 is performed.

The first scan signal is supplied to the third first scan signal S13 during a third horizontal period T23. In addition, the switching module 230 of the data driver 20 is controlled to be in the on-state during the third horizontal period T23. Accordingly, the bias signal is supplied to the data lines D1 to Dm from the data driver 20.

When the bias signal is supplied to the data lines D1 to Dm, and the first scan signal is supplied to the third first scan line S13, the bias signal may be supplied to pixels 50 included in a third pixel row such that a bias operation on the corresponding pixels 50 is performed.

Meanwhile, the parasitic capacitor Cp of each of the data lines D1 to Dm is charged with the bias voltage by the bias signal supplied to the data lines D1 to Dm during the third horizontal period T23.

The first scan signal is supplied to the nth first scan line S1*n* during an nth horizontal period T2*n*. In addition, the switching module 230 of the data driver 20 is controlled to be in the off-state during the nth horizontal period T2*n*. Accordingly, the bias signal is not supplied to the data lines D1 to Dm from the data driver 20. When the parasitic capacitor Cp charged with the bias signal during an (n-1)th horizontal period T2*n*-1 is discharged, the bias signal may be supplied to each of the data lines D1 to Dm.

When the bias signal is supplied to the data lines D1 to Dm, and the first scan signal is supplied to the nth first scan line S1*n*, the bias signal may be supplied to pixels 50 included in an nth pixel row such that a bias operation on the corresponding pixel 50 is performed.

As described above, the display device according to the present disclosure can supply the bias signal to the pixel rows from the data driver 20 or the parasitic capacitor Cp while controlling on/off of the switching module 230 of the data driver 20 in units of horizontal periods during the bias period BP. Accordingly, the display device according to the present disclosure can reduce power consumption caused by the data driver 20 during the bias period BP, and can effectively perform the bias operation on the pixels 50.

Figure 6:
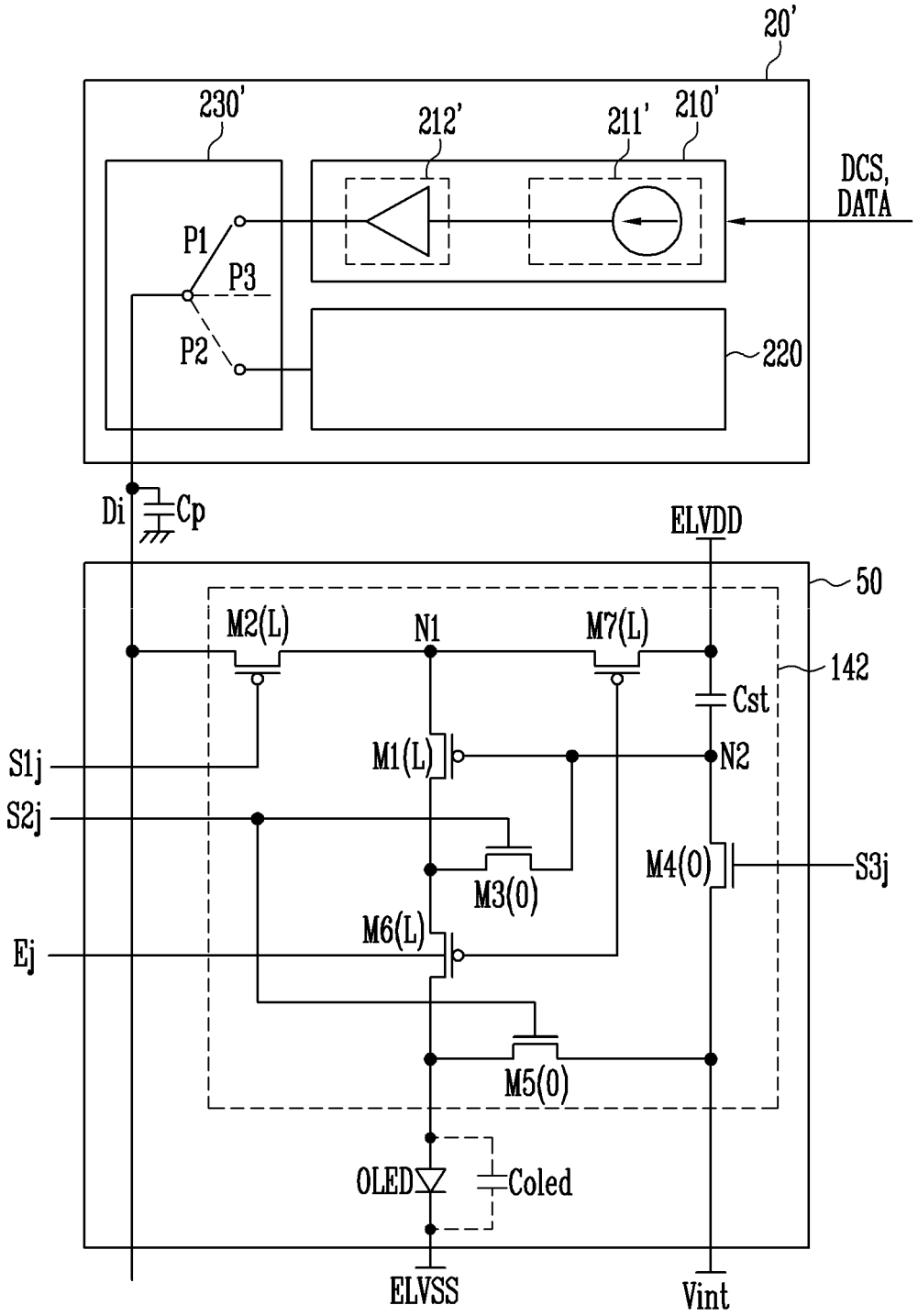
FIG. 6 is a diagram illustrating another embodiment of the pixel and data driver, which are shown in FIG. 1.

FIG. 6 is a diagram illustrating another embodiment of the pixel and data driver, which are shown in FIG. 1. For convenience of description, an example in which a pixel 50 is located on a jth horizontal line and is coupled to a data driver 20' through an ith data line Di is illustrated in FIG. 6.

Referring to FIG. 6, the data driver 20' according to the present embodiment includes a data driving module 210', an analog voltage input module 220, and a switching module 230'. Although only one data driving module 210', one analog voltage input module 220, and one switching module 230', which are coupled to the ith data line Di, are illustrated for convenience of description, the present disclosure is not limited thereto. That is, in various embodiments, the data driver 20' may include a plurality of data driving modules 210', a plurality of analog voltage input modules 220, and a plurality of switching modules 230', which are respectively coupled to the data lines D1 to Dm. Alternatively, in various embodiments, the data driver 20' may include a plurality of switching modules 230' coupled between both one data driving module 210' and one analog voltage input module 220, and the data lines D1 to Dm.

The data driving module 210' receives the data driving control signal DOS and image data DATA from the timing controller 60 during a display period. The data driving module 210' converts the image data DATA into a data signal, and outputs the converted data signal to the switching module 230'.

In various embodiments, the data driving module 210' may include a source unit 211' and a buffer unit 212'.

The source unit 211' generates a data signal having a voltage corresponding to a grayscale value of the image data DATA, and outputs the generated data signal to the buffer unit 212'. The buffer unit 212' compensates for the data signal such that the voltage of the data signal has a constant level, and outputs the compensated data signal to the data line Di. The buffer unit 212' may include, for example, an amplifier in the form of a source follower.

The data driving module 210' may further include a shift register and a latch. The shift register shifts image data transferred from the timing controller 60 to correspond to the data line Di. The latch temporarily stores the image data shifted by the shift register, and outputs the stored image data to a corresponding source unit 211'.

The analog voltage input module 22Q provides a bias signal having an analog voltage to the switching module 230' during a bias period including at least one frame after the display period. In an embodiment, the bias signal may have a level that is higher than that of a data signal corresponding to a white grayscale, which is applied to the data line Di.

In various embodiments of the present disclosure, the analog voltage input module 220 may have the same structure as the data driving module 210', but the present disclosure is not limited thereto.

The switching module 230' controls an output of the data driving module 210'. For example, the switching module 230' controls the data signal or the bias signal to be output or to not be output to the data line Di from the data driving module 210' by controlling on/off of an output of the amplifier of the buffer unit 212'.

An operation of the switching module 230' may be controlled by the timing controller 60. For example, the timing controller 60 may allow the data signal to be output to the data line Di by controlling the switching module 230' to a first position P1 such that the data driving module 210' and the data line Di are electrically coupled to each other during the display period.

Meanwhile, the timing controller 60 may allow the bias signal to be output to the data line Di by controlling the switching module 230' to a second position P2 such that the analog voltage input module 220 and the data line Di are electrically coupled to each other during the bias period.

In an embodiment, the timing controller 60 may allow the data signal or the bias signal to not be output to the data line Di by controlling the switching module 230' to a third position P3 during at least a portion of the bias period.

Continuing to refer to FIG. 6, the pixel 50 according to the present embodiment receives a scan signal through a jth first scan line S1*j*, and is supplied with an emission control signal through a jth emission control line Ej. The pixel 50 of FIG. 6 is the same as shown in FIG. 2, and therefore, its detailed description will not be repeated.

Meanwhile, in various embodiments of the present disclosure, a parasitic capacitor Cp may be equally formed in the data line Di. The parasitic capacitor Cp may be replaced with a separate data capacitor additionally formed in the data line Di. The parasitic capacitor Cp serves as a source capacitor that temporarily stores a data signal or bias signal, which is supplied to the data line Di, and supplies the stored data signal or bias signal to the pixel 50.

Figure 7:
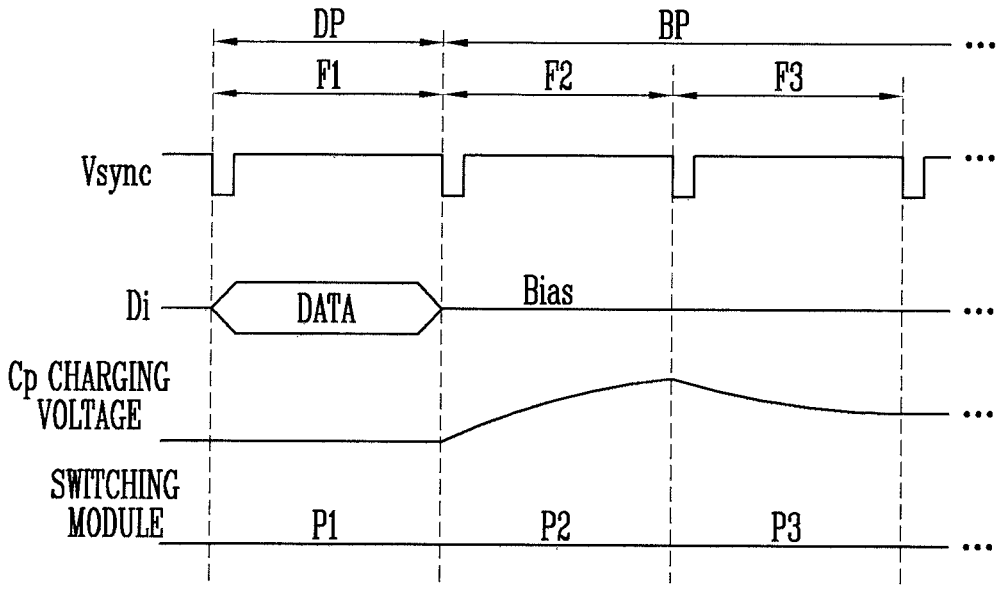
FIG. 7 is a timing diagram illustrating a driving method of the display device according to a third embodiment of the present disclosure.

FIG. 7 is a timing diagram illustrating a driving method of the display device according to a third embodiment of the present disclosure. In FIG. 7, only a signal corresponding to an ith data line Di is illustrated for convenience of description.

In FIG. 7, a pulse timing of a vertical synchronization signal Vsync is illustrated. The vertical synchronization signal Vsync is a signal for defining one frame period of the display device. That is, the period of a pulse of the vertical synchronization signal Vsync may be set to become the one frame period.

Referring to FIGS. 1, 3, 6, and 7, a first frame F1 corresponds to a display period DP in which a data signal is supplied to the pixel 50, and second to nth frames F2 to Fn correspond to a bias period BP in which the data signal is not supplied to the pixel 50.

During the display period DP, the display device performs driving for image display. During the display period DP, the switching module 230' of the data driver 20' is controlled to be in the first position P1, to supply a data signal to the data lines D1 to Dm. The display device sequentially control supply of an emission control signal and first to third scan signals to respective pixel rows to store a voltage corresponding to the data signal in the pixels 50 of all the pixel rows. A driving method during the display period DP is the same as described in FIG. 3, and therefore, its detailed description will be omitted.

During the bias period BP, the display device performs bias driving for reducing or preventing the deterioration of the characteristics of the driving transistor included in the pixel 50. The display device supplies a bias signal to the pixels 50 through the data lines D1 to Dm. In the third embodiment of the present disclosure, the display device supplies the bias signal to the data lines D1 to Dm from the data driver 20' in at least one frame during the bias period BP, and supplies the bias signal to the data lines D1 to Dm from the parasitic capacitor Cp in at least one other frame during the bias period BP.

For example, during the second frame F2, the switching module 230' of the data driver 20' is controlled to be in the second position P2. Accordingly, the bias signal is supplied to the data lines D1 to Dm from the data driver 20'. When the bias signal is supplied to the data lines D1 to Dm, and the supplies of the emission control signal and the first scan signal to the respective pixel rows are sequentially controlled, a bias operation on the pixels 50 on all the pixel rows can be performed.

Meanwhile, during the second frame F2, the parasitic capacitor Cp of each of the data lines D1 to Dm is charged with a bias voltage by the bias signal supplied to the data lines D1 to Dm.

During the third frame F3, the switching module 230' of the data driver 20' is controlled to be in the third position P3. Accordingly, the bias signal is not supplied to the data lines D1 to Dm from the data driver 20'. When the parasitic capacitor Cp charged with the bias signal during the second frame F2 is discharged, the bias signal may be supplied to each of the data lines D1 to Dm.

When the first scan signal is sequentially supplied to the pixel rows, the second transistor M2(L) included in each of the pixels 50 is turned on. That is, when the second transistor M2(L) is turned on, a voltage of the bias signal, which is charged in the parasitic capacitor Cp during the previous frame F2, is supplied to the first node of each of the pixels 50, and accordingly, the first transistor M1(L) may be set to be in the on-bias state.

As described above, the display device according to the present disclosure can supply the bias signal to the pixel 50 from the data driver 20' or the parasitic capacitor Cp while controlling on/off of the switching module 230' of the data driver 20' in units of frames during the bias period BP. Accordingly, the display device according to the present disclosure can reduce power consumption caused by the data driver 20' during the bias period BP, and can effectively perform the bias operation on the pixels 50.

Figure 8:
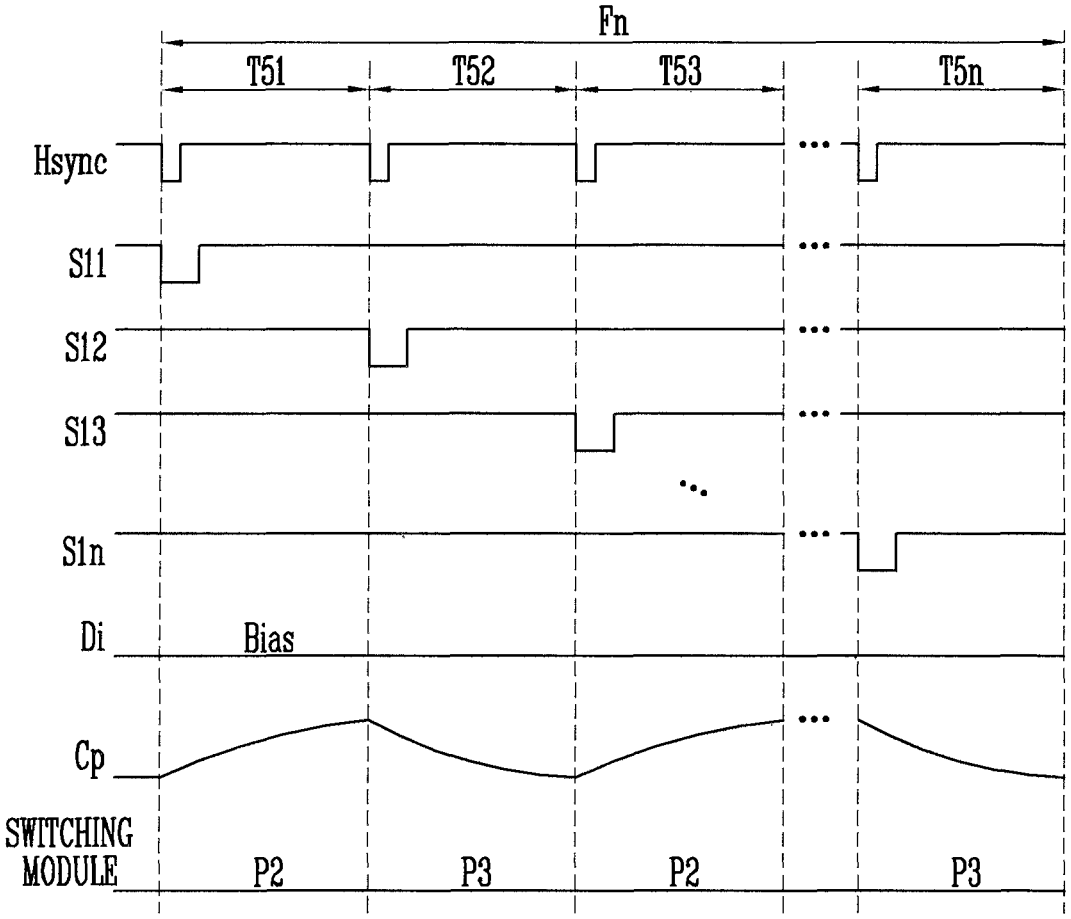
FIG. 8 is a timing diagram illustrating a driving method of the display device according to a fourth embodiment of the present disclosure.

FIG. 8 is a timing diagram illustrating a driving method of the display device according to a fourth embodiment of the present disclosure. For convenience of description, only signals corresponding to an ith data line Di, a first first scan line S11, a second first scan line S12, a third first scan line S13, and an nth first scan line Sin are illustrated in FIG. 8.

In FIG. 8, a pulse timing of a horizontal synchronization signal Hsync is illustrated. The horizontal synchronization signal Hsync is a signal for defining one horizontal period 1H. That is, the period of a pulse of the horizontal synchronization signal Hsync may be set to become the one horizontal period. In addition, an n frame Fn that is an arbitrary frame during a bias period BP is illustrated in FIG. 5. The display device performs driving for image display during a display period DP, and an operation in the display period DP is the same as described with reference to FIG. 3.

Referring to FIGS. 1 to 3, 6, and 8, during the bias period BP, the display device performs bias driving for reducing or preventing the deterioration of the characteristics of the driving transistor included in the pixel 50. The display device supplies a bias signal to the pixels 50 through the data lines D1 to Dm. In the fourth embodiment of the present disclosure, the display device supplies the bias signal to the data lines D1 to Dm from the data driver 20' in at least one horizontal period within one frame during the bias period BP, and supplies the bias signal to the data lines D1 to Dm from the parasitic capacitor Cp in at least one other horizontal period within the one frame during the bias period BP.

For example, a first scan signal is supplied to the first first scan line S11 during a first horizontal period T51 within the nth frame Fn. In addition, the switching module 230' of the data driver 20' is controlled to be in the second position P2 during the first horizontal period T51. Accordingly, the bias signal is supplied to the data lines D1 to Dm from the data driver 20'.

When the bias signal is supplied to the data lines D1 to Dm, and the first scan signal is supplied to the first first scan line S11, the bias signal may be supplied to pixels 50 included in a first pixel row such that a bias operation on the corresponding pixels 50 is performed.

Meanwhile, the parasitic capacitor Cp of each of the data lines D1 to Dm is charged with a bias voltage by the bias signal supplied to the data lines D1 to Dm during the first horizontal period T51.

The first scan signal is supplied to the second first scan line S12 during a second horizontal period T52. In addition, the switching module 230' of the data driver 20' is controlled to be in the third position P3 during the second horizontal period T52. Accordingly, the bias signal is not supplied to the data lines D1 to Dm from the data driver 20'. When the parasitic capacitor Cp, which is charged with the bias signal during the first horizontal period T51, is thereafter discharged, the bias signal may be supplied to each of the data lines D1 to Dm.

When the bias signal is supplied to the data lines D1 to Dm, and the first scan signal is supplied to the second first scan signal S12, the bias signal may be supplied to pixels 5Q included in a second pixel row such that a bias operation on the corresponding pixels 50 is performed.

The first scan signal is supplied to the third first scan signal S13 during a third horizontal period T53. In addition, the switching module 230' of the data driver 20' is controlled to be in the second position P2 during the third horizontal period T53. Accordingly, the bias signal is supplied to the data lines D1 to Dm from the data driver 20'.

When the bias signal is supplied to the data lines D1 to Dm, and the first scan signal is supplied to the third first scan line S13, the bias signal may be supplied to pixels 50 included in a third pixel row such that a bias operation on the corresponding pixels 50 is performed.

Meanwhile, the parasitic capacitor Cp of each of the data lines D1 to Dm is charged with the bias voltage by the bias signal supplied to the data lines D1 to Dm during the third horizontal period T53.

The first scan signal is supplied to the nth first scan line S1*n* during an nth horizontal period T5*n*. In addition, the switching module 230' of the data driver 20' is controlled to be in the third position P3 during the nth horizontal period T5*n*. Accordingly, the bias signal is not supplied to the data lines D1 to Dm from the data driver 20'. When the parasitic capacitor Cp charged with the bias signal during an (n-1)th horizontal period T5*n*-1 is discharged, the bias signal may be supplied to each of the data lines D1 to Dm.

When the bias signal is supplied to the data lines D1 to Dm, and when the first scan signal is supplied to the nth first scan line S1*n*, the bias signal may be supplied to pixels 50 included in an nth pixel row such that a bias operation on the corresponding pixel 50 is performed.

As described above, the display device according to the present disclosure can supply the bias signal to the pixel rows from the data driver 20' or the parasitic capacitor Cp while controlling on/off of the switching module 230' of the data driver 20' in units of horizontal periods during the bias period BP. Accordingly, the display device according to the present disclosure can reduce power consumption caused by the data driver 20' during the bias period BP, and can effectively perform the bias operation on the pixels 50.

In the display device and the driving method thereof according to the present disclosure, on/off control of the output of a bias voltage is performed during a bias period when the display device is driven at a low frequency such that power consumption can be further reduced.

Embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims with functional equivalents thereof to be include herein.

What is claimed is:

1. A display device comprising:

pixels that are coupled to data lines, that are supplied with a data signal during a display period, and that are configured to emit light corresponding to the data signal during the display period and a bias period;

a source capacitor coupled to each of the data lines; and a data driver configured to supply the data signal during the display period, to supply a bias signal during a first period in the bias period, and to not supply the bias signal during a second period, the first period being after the display period and before the second period, wherein the bias signal has a voltage level that is higher than that of the data signal, and is supplied to a source electrode or a drain electrode of a driving transistor of a respective one of the pixels via a switching transistor of the respective one of the pixels that is configured to receive a scan signal.

2. The display device of claim 1, wherein the data driver is configured to supply the pixels with the bias signal during the first period, and wherein the source capacitor is configured to supply the pixels with the bias signal during the second period.

3. The display device of claim 1, wherein the first period and the second period correspond to one frame period.

4. The display device of claim 1, wherein the first period and the second period correspond to one horizontal period.

5. The display device of claim 1, wherein the data driver comprises:

a data driving module configured to supply the data signal and the bias signal to the data lines; and a switching module configured to control electrical coupling between the data driving module and the data lines.

6. The display device of claim 5, wherein the switching module is in an on-state during the display period and the first period, and is in an off-state during the second period.

7. The display device of claim 1, wherein the data driver comprises:

a data driving module configured to supply the data signal to the data lines;

an analog voltage input module configured to supply the bias signal to the data lines; and a switching module configured to control electrical coupling between the data driving module and the data lines, and between the analog voltage input module and the data lines.

8. The display device of claim 7, wherein the switching module is controlled to be in a first position in which the data driving module is coupled to the data lines during the display period, is controlled to be in a second position in which the analog voltage input module is coupled to the data lines during the first period, and is controlled to be in a third position in which the data driving module and the analog voltage input module are separated from the data lines during the second period.

9. The display device of claim 1, wherein the source capacitor is configured to charge the bias signal supplied from the data driver during the first period, and is configured to be discharged during the second period to supply the bias signal to a corresponding one of the data lines.

10. The display device of claim 1, wherein the source capacitor is a parasitic capacitor of a corresponding one of the data lines.

11. A method for driving a display device comprising pixels that are coupled to data lines and that are supplied with a data signal during a display period, a source capacitor coupled to each of the data lines, and a data driver that is configured to supply a bias signal during a first period in a bias period, and that is configured to not supply the bias signal during a second period, the method comprising:

supplying, by the data driver, the data signal to the data lines during the display period;

supplying the bias signal to the data lines during the first period in the bias period, the first period being after the display period and before the second period; and stopping the supply of the bias signal to the data lines during the second period, and wherein the pixels are configured to emit light corresponding to the data signal during the display period and the bias period, and wherein the bias signal has a voltage level that is higher than that of the data signal, and is supplied to a source electrode or a drain electrode of a driving transistor of a respective one of the pixels via a switching transistor of the respective one of the pixels that is configured to receive a scan signal.

12. The method of claim 11, wherein the pixels are supplied with the bias signal from the data driver during the first period, and are supplied with the bias signal from the source capacitor during the second period.

13. The method of claim 11, wherein the first period and the second period correspond to one frame period.

14. The method of claim 11, wherein the first period and the second period correspond to one horizontal period.

15. The method of claim 11, wherein the data driver comprises: a data driving module configured to supply the data signal and the bias signal to the data lines; and a switching module configured to control electrical coupling between the data driving module and the data lines.

16. The method of claim 15, wherein the supplying of the bias signal comprises controlling the switching module to be in an on-state, and wherein the stopping of the supply of the bias signal comprises controlling the switching module-to be in an off-state.

17. The method of claim 11, wherein the data driver comprises:

a data driving module configured to supply the data signal to the data lines;

an analog voltage input module configured to supply the bias signal to the data lines; and a switching module configured to control electrical coupling between the data driving module and the data lines, and between the analog voltage input module and the data lines.

18. The method of claim 17, wherein the supplying of the data signal comprises controlling the switching module to be in a first position in which the data driving module is coupled to the data lines during the display period, wherein the supplying of the bias signal comprises controlling the switching module to be in a second position in which the analog voltage input module is coupled to the data lines during the first period, and wherein the stopping of the supply of the bias signal comprises controlling the switching module to be in a third position in which the data driving module and the analog voltage input module are separated from the data lines during the second period.

19. The method of claim 11, further comprising charging the source capacitor with the bias signal supplied from the data driver during the first period, and discharging the source capacitor during the second period to supply the bias signal to a corresponding one of the data lines.

20. The method of claim 11, wherein the source capacitor is a parasitic capacitor of a corresponding one of the data lines.

* * * * *